US008786213B2

(12) United States Patent
Yang et al.

(10) Patent No.: US 8,786,213 B2
(45) Date of Patent: Jul. 22, 2014

(54) COMPENSATING LED CURRENT BY LED CHARACTERISTICS FOR LED DIMMING CONTROL

(71) Applicant: Richtek Technology Corporation, Chupei (TW)

(72) Inventors: Shei-Chie Yang, Wur Township, Taichung County (TW); Shui-Mu Lin, Longjing Township, Taichung County (TW); Jun-Sheng Cheng, Kaohsiung (TW); Ming-Yu Lin, Tainan (TW); Chun-I Lin, Yangmei (TW)

(73) Assignee: Richtek Technology Corp., Chupei, Hsinchu (TW)

( * ) Notice: Subject to any disclaimer, the term of this patent is extended or adjusted under 35 U.S.C. 154(b) by 99 days.

(21) Appl. No.: 13/706,219

(22) Filed: Dec. 5, 2012

(65) Prior Publication Data

US 2013/0147385 A1 Jun. 13, 2013

(30) Foreign Application Priority Data

Dec. 7, 2011 (TW) ..... 100145058 A

(51) Int. Cl.
*H05B 37/02* (2006.01)

(52) U.S. Cl.
USPC ..... 315/307; 315/291; 315/294; 315/297; 363/19; 363/21.01; 323/282

(58) Field of Classification Search
CPC ..... H05B 33/0833; H05B 33/0818; H05B 33/0827; H05B 33/0815; H05B 33/0803; H05B 41/2828; H05B 41/3927; Y02B 20/347
USPC ..... 315/291, 294, 297, 307, 312; 363/19, 363/21.01, 21.1; 323/282, 283
See application file for complete search history.

(56) References Cited

U.S. PATENT DOCUMENTS

| | | | | |
|---|---|---|---|---|
| 8,107,825 | B2 * | 1/2012 | Rajagopal et al. | 398/172 |
| 8,390,262 | B2 * | 3/2013 | Chang et al. | 323/282 |
| 8,487,546 | B2 * | 7/2013 | Melanson | 315/291 |
| 8,564,155 | B2 * | 10/2013 | Wibben | 307/31 |

* cited by examiner

*Primary Examiner* — Haiss Philogene
(74) *Attorney, Agent, or Firm* — Muncy, Geissler, Olds & Lowe, P.C.

(57) ABSTRACT

LED dimming control circuit and method compensate LED current or LED average current by LED characteristics to improve dimming efficiency and performance. LED characteristic related look-up tables are stored to provide compensation values, and input LED current setting information is compensated by the compensation values to generate corrected LED current setting information for determining LED brightness.

21 Claims, 9 Drawing Sheets

COMPENSATING LED CURRENT BY LED CHARACTERISTICS FOR LED DIMMING CONTROL

FIELD OF THE INVENTION

The present invention is related generally to a driver controller for light emitting diode (LED) and, more particularly, to LED dimming control circuit and method.

BACKGROUND OF THE INVENTION

Conventional LED dimming control methods mainly have two ways to control brightness: pulse width modulation (PWM) dimming and direct-current (DC) dimming. PWM dimming process switches a switch to control the average of LED current, and thus if use PWM dimming to control LED brightness, the LED brightness can be linearly controlled by LED average current IF_avg as shown by the curve 10 in FIG. 1. DC dimming process controls the LED current, and thus if use DC dimming to control LED brightness, the LED brightness is not linearly proportional to LED average current IF_avg as shown by the curve 12 in FIG. 1. It is difficult for DC dimming to achieve linear LED dimming control. However, although PWM dimming can achieve linear LED dimming control, in some brightness, for example, the level BR designated in FIG. 1, the LED average current IF_avg by DC dimming is less than by PWM dimming. Therefore, DC dimming can save input power to get a same brightness. On the other hand, as shown in FIG. 2, LED brightness is also affected by ambient temperature. For example, when the temperature of LED is lower, the brightness is higher. Therefore, it could decrease LED current to achieve proper brightness to save power.

SUMMARY OF THE INVENTION

An objective of the present invention is to provide LED dimming control circuit and method for accomplishing linear LED dimming control by using DC dimming.

Another objective of the present invention is to provide LED dimming control circuit and method for compensating LED current or LED average current by LED characteristics.

A further objective of the present invention is to provide LED dimming control circuit and method to improve LED flick and PWM output resolution in PWM dimming.

LED dimming control circuit and method according to the present invention use a storage unit to store a LED characteristic look-up table, and determine compensation values according to LED current setting information and the look-up table to compensate the LED current setting information, thus achieving linear LED dimming control in DC dimming mode. Additionally, in PWM dimming mode, the LED dimming control circuit and method can improve LED flick and PWM output resolution by PWM learning mechanism.

BRIEF DESCRIPTION OF THE DRAWINGS

These and other objectives, features and advantages of the present invention will become apparent to those skilled in the art upon consideration of the following description of the preferred embodiments of the present invention taken in conjunction with the accompanying drawings, in which.

DETAILED DESCRIPTION OF THE INVENTION

Figure 1:
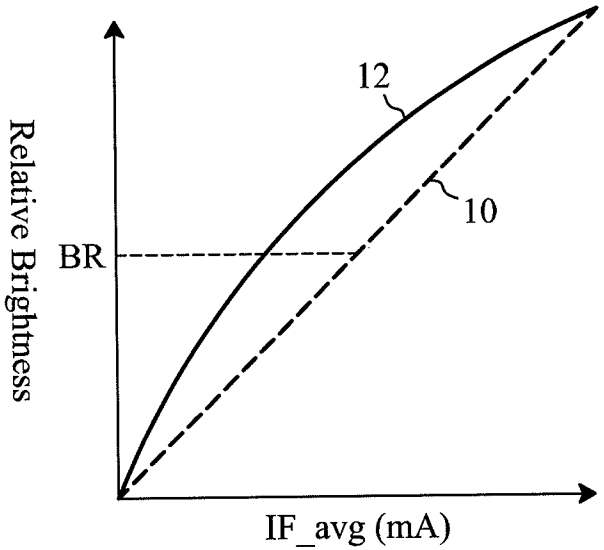
Fig. 1 Prior Art
FIG. 1 shows relative LED brightness versus LED average current characteristic by PWM and DC dimming.
Figure 2:
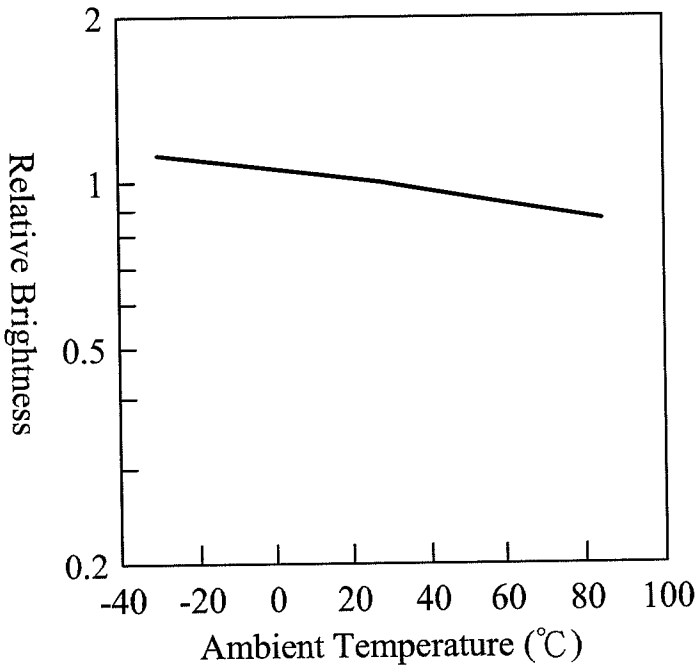
Fig. 2 Prior Art
FIG. 2 shows one relative LED brightness versus temperature characteristic.
Figure 3:
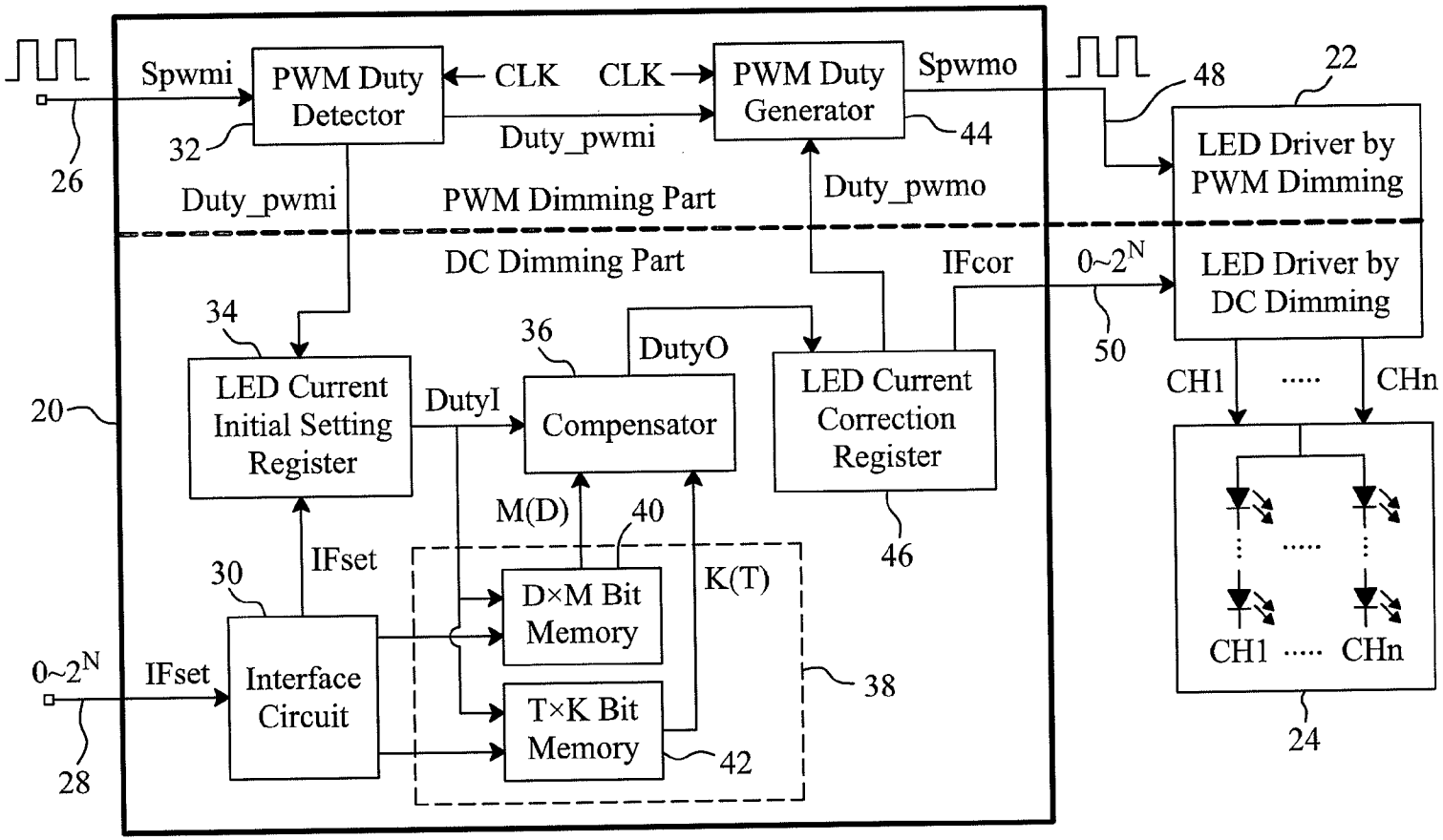
FIG. 3 shows a first embodiment of a LED dimming control circuit according to the present invention.

FIG. 3 shows an embodiment of a LED dimming control integrated circuit (IC) 20 according to the present invention, which includes input terminals 26 and 28 to receive an input PWM signal Spwmi and an input LED current setting information IFset, respectively, and output terminals 48 and 50 to output a corrected PWM signal Spwmo and a corrected LED current setting information IFcor, respectively. The LED dimming control IC 20 has an embedded storage unit 38 to store LED characteristic data and, according to the LED characteristic data, compensates the input duty information DutyI derived from the input PWM signal Spwmi or the LED current setting information IFset, to generate output duty information DutyO for generating the corrected PWM signal Spwmo or the corrected LED current setting information IFcor, for a LED driver 22 to drive a LED light source module 24. In this embodiment, the LED light source module 24 includes a plurality of LED strings CH1-CHn, and each LED string CH1-CHn includes a plurality of LEDs connected in series. The LED current setting information IFset and IFcor may be a digital signal of N-bits, thus each of which may provide values of $0\text{-}2^N$. The LED dimming control IC 20 has a PWM dimming mode and a DC dimming mode to control brightness of each LED string CH1-CHn. In the DC dimming mode, the LED driver 22 performs DC dimming to control LED current of the LED strings CH1-CHn according to the corrected LED current information IFcor. In the PWM dimming mode, the LED driver 22 performs PWM dimming to control LED average current of the LED strings CH1-CHn according to the corrected PWM signal Spwmo.

In the LED dimming control IC 20 shown in FIG. 3, an interface circuit 30 is connected to the input terminal 28 to transmit the LED current setting information IFset to a LED current initial setting register 34, and the interface circuit 30 may also write LED characteristic related correction data into the embedded storage unit 38, for example, write or update a look-up table of brightness versus LED current and a look-up table of brightness versus temperature into memories 40 and 42 in the storage unit 38, respectively. A PWM duty detector 32 is connected to the input terminal 26 and, responsive to a clock signal CLK inside the LED dimming control IC 20, detects duty of the input PWM signal Spwmi to transmit the input duty information Duty_pwmi to the LED current initial setting register 34. Specifically, supposed that the input duty information Duty_pwmi is 8-bit data, then the input duty information Duty_pwmi has values ranging between 0 and 255, and, for example, if the input PWM signal Spwmi has a duty of 75%, then the input duty information Duty_pwmi=255×0.75≈191. The LED current initial setting register 34 stores either of the LED current setting information IFset and the input duty information Duty_pwmi, and provides the input duty information DutyI to a compensator 36 and the storage unit 38. The memory 40 in the storage unit 38 determines compensation values M(D) according to the input duty information DutyI and the look-up table of brightness versus LED current stored in the memory 40, where D represents a brightness step and has a maximum value of $2^N$, and M represents a brightness ratio of PWM dimming brightness to DC dimming brightness at a specific LED current. The memory 42 in the storage unit 38 determines compensation values K(T) according to the input duty information DutyI and the look-up table of brightness versus temperature stored in the memory 42, where T represents a temperature step, and K represents a brightness ratio between a specific temperature and a minimum temperature. Based on the compensation values M(D) and K(T), the compensator 36 compensates the input duty information DutyI to generate the output duty information DutyO to be stored in a LED current correction register 46. The compensator 36 may be implemented in many ways, for example, including a multiplier to multiply the input duty information DutyI by the compensation values M(D) and K(T) to generate the output duty information DutyO. For DC diming, the LED current correction register 46 transmits the corrected LED current setting information IFcor derived from the stored output duty information DutyO, to the LED driver 22 via the output terminal 50 to set the LED current of the LED strings CH1-CHn. For PWM diming, the LED current correction register 46 transmits corrected duty information Duty_pwmo derived from the stored output duty information DutyO, to a PWM duty generator 44, and responsive to the internal clock signal CLK, the PWM duty generator 44 generates the corrected PWM signal Spwmo according to the corrected duty information Duty_pwmo to be transmitted to the LED driver 22 via the output terminal 48 to control the LED average current of the LED strings CH1-CHn. In addition, the PWM duty generator 44 may further control the varying speed of the duty of the output PWM signal Spwmo according to the input duty information Duty_pwmi, to prevent the duty of the output PWM signal Spwmo from fast varying to cause flick of the LED strings CH1-CHn.

Figure 4:
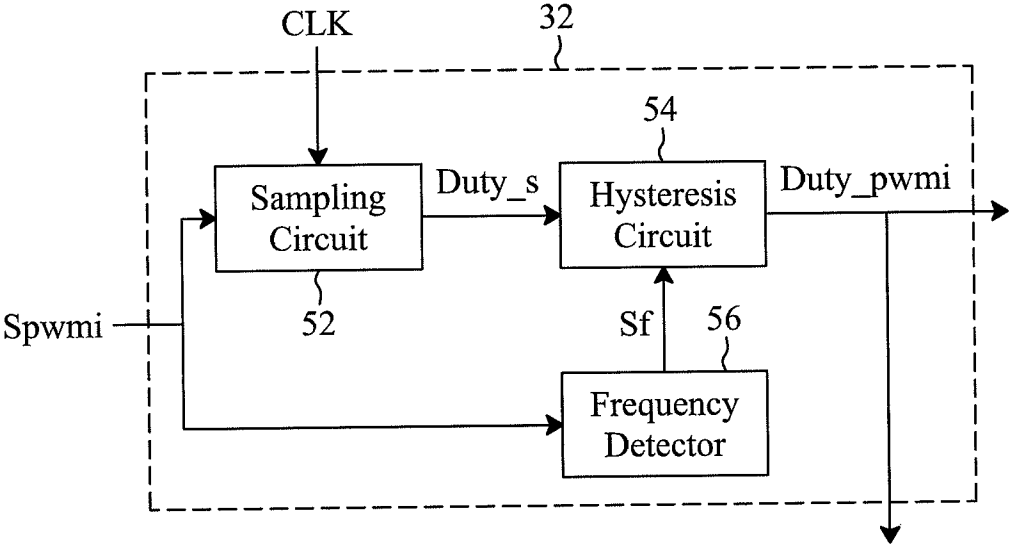
FIG. 4 shows an embodiment of the PWM duty detector in FIG. 3.

FIG. 4 shows an embodiment of the PWM duty detector 32 in FIG. 3, which includes a sampling circuit 52, a hysteresis circuit 54 and a frequency detector 56. The sampling circuit 52 samples the duty of the input PWM signal Spwmi responsive to the internal clock signal CLK, to generate sample values Duty_s. The hysteresis circuit 54 has an upper bound Hy_up and a lower bound Hy_low. Supposed that the sampling circuit 52 samples the duty of the PWM signal Spwmi for an (n+1)th time to generate a sample value Duty_s(n+1), the hysteresis circuit 54 which stores a sample value Duty_s(n) obtained by the sampling circuit 52 in a previous sampling process, determines the input duty information Duty_pwmi according to the sample values Duty_s(n+1) and Duty_s(n), and the upper bound Hy_up and the lower bound Hy_low. Additionally, with the upper bound Hy_up and the lower bound Hy_low, the hysteresis circuit 54 implements a PWM learning mechanism which can maintain the input duty information Duty_pwmi stable when the duty of the PWM signal Spwmi is little jittering, to thereby prevent LED flick.

Figure 5:
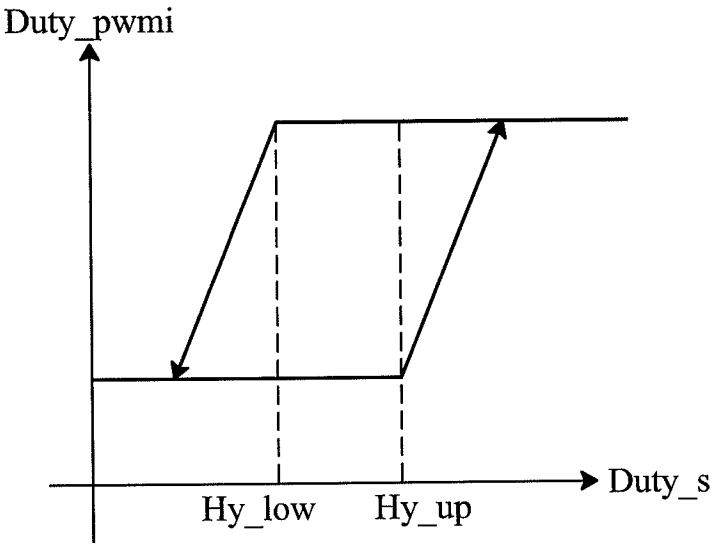
FIG. 5 illustrates a PWM leaning mechanism.

FIG. 5 illustrates the PWM learning mechanism. When the sample value Duty_s(n+1) is greater than the previous sample value Duty_s(n) and is greater than the upper bound Hy_up, the hysteresis circuit 54 generates the input duty information Duty_pwmi according to the sample value Duty_s(n+1). When the sample value Duty_s(n+1) is smaller than the previous sample value Duty_s(n) and is smaller than the lower bound Hy_low, the hysteresis circuit 54 also generates the input duty information Duty_pwmi according to the sample value Duty_s(n+1). For the other cases, the hysteresis circuit 54 maintains the input duty information Duty_pwmi unchanged to prevent LED flick.

The internal clock signal CLK is at a fixed frequency, and thus will cause deviation between the input PWM signal Spwmi and the real LED brightness. This deviation is not a constant time for different PWM speed, but varies with the frequency of the input PWM signal Spwmi. If a fixed upper bound Hy_up and a fixed lower bound Hy_low are used, it will sacrifice the PWM output resolution in high speed PWM (Spwmi at a high frequency), and may cause observable LED flick in low speed PWM (Spwmi at a low frequency). In view of these problems, as shown in FIG. 4, the frequency detector 56 detects the frequency of the input PWM signal Spwmi to generate a detection signal Sf for signaling the hysteresis circuit 54 to adjust its upper bound Hy_up and lower bound Hy_low, thereby improving the PWM output resolution when the input PWM signal Spwmi is at a high frequency, and eliminating LED flick when the input PWM signal Spwmi is at a low frequency.

When the LED dimming control IC 20 shown in FIG. 3 performs DC dimming, no matter it is provided the PWM signal Spwmi or the LED current setting information IFset to the LED dimming control IC 20, it is always the corrected LED current setting information IFcor being provided for the LED driver 22 to achieve DC dimming. In the DC dimming mode, the LED dimming control IC 20 can achieve linear LED dimming according to the compensation values M(D) and K(T) provided by the storage unit 38, and the LED average current is less than the LED average current in the PWM dimming mode for the same brightness, thereby saving the input power.

When the LED dimming control IC 20 shown in FIG. 3 performs PWM dimming, no matter it is provided the PWM signal Spwmi or the LED current setting information IFset to the LED dimming control IC 20, it is always the corrected PWM signal Spwmo being provided to the LED driver 22 to achieve PWM dimming. In the PWM dimming mode, LED flick caused by change of the duty of the input PWM signal Spwmi is avoided because of the PWM learning mechanism of the PWM duty detector 32. Moreover, by adjusting the upper bound Hy_up and the lower bound Hy_low according to the frequency of the input PWM signal Spwmi, the LED dimming control IC 20 may further improve the PWM output resolution when the PWM signal Spwmi is at a high frequency and eliminate LED flick when the PWM signal Spwmi is at a low frequency.

Figure 6:
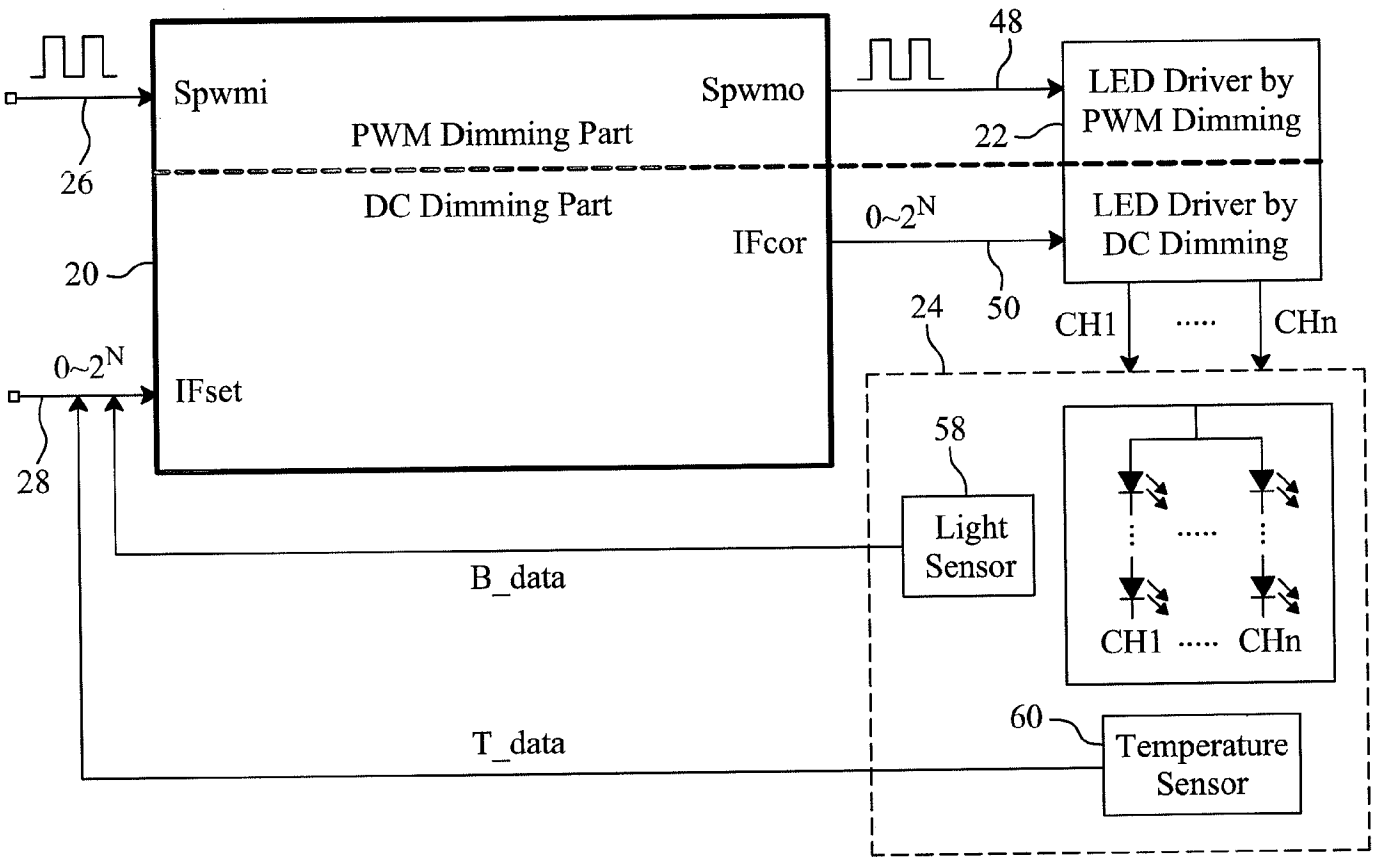
FIG. 6 shows an embodiment of choosing compensation values according to LED brightness and ambient temperature.

The LED dimming control IC 20 may also continuously improve LED dimming efficiency and performance according to present LED brightness and ambient temperature. As shown in FIG. 6, a light sensor 58 and a temperature sensor 60 are disposed in the LED light source module 24 to sense the brightness and the ambient temperature of the LED strings CH1-CHn to generate present LED brightness data B_data and LED temperature data T_data, respectively. In FIG. 6, the circuit in the LED dimming control IC 20 is the same as that shown in FIG. 3, and is not shown in FIG. 6 for simplicity. Via the input terminal 28 and the interface circuit 30, the LED brightness data B_data and the LED temperature data T_data are transmitted to the memories 40 and 42, respectively. The memories 40 and 42 have a plurality of look-up tables stored therein, respectively, and choose a most appropriate look-up table according to the LED brightness data B_data and the LED temperature data T_data to provide optimal compensation values M(D) and K(T), respectively.

In addition to the brightness correction data and the temperature correction data, other correction data, for example, color shift correction data, of LED characteristics may be used to compensate LED current or LED average current. Moreover, the performances of different color (e.g. RGB) LEDs are different, and the LED dimming control IC 20 also can properly control their DC currents to get better luminance efficiency by the respective LED characteristics written into look-up tables stored in the storage unit 38.

Figure 7:
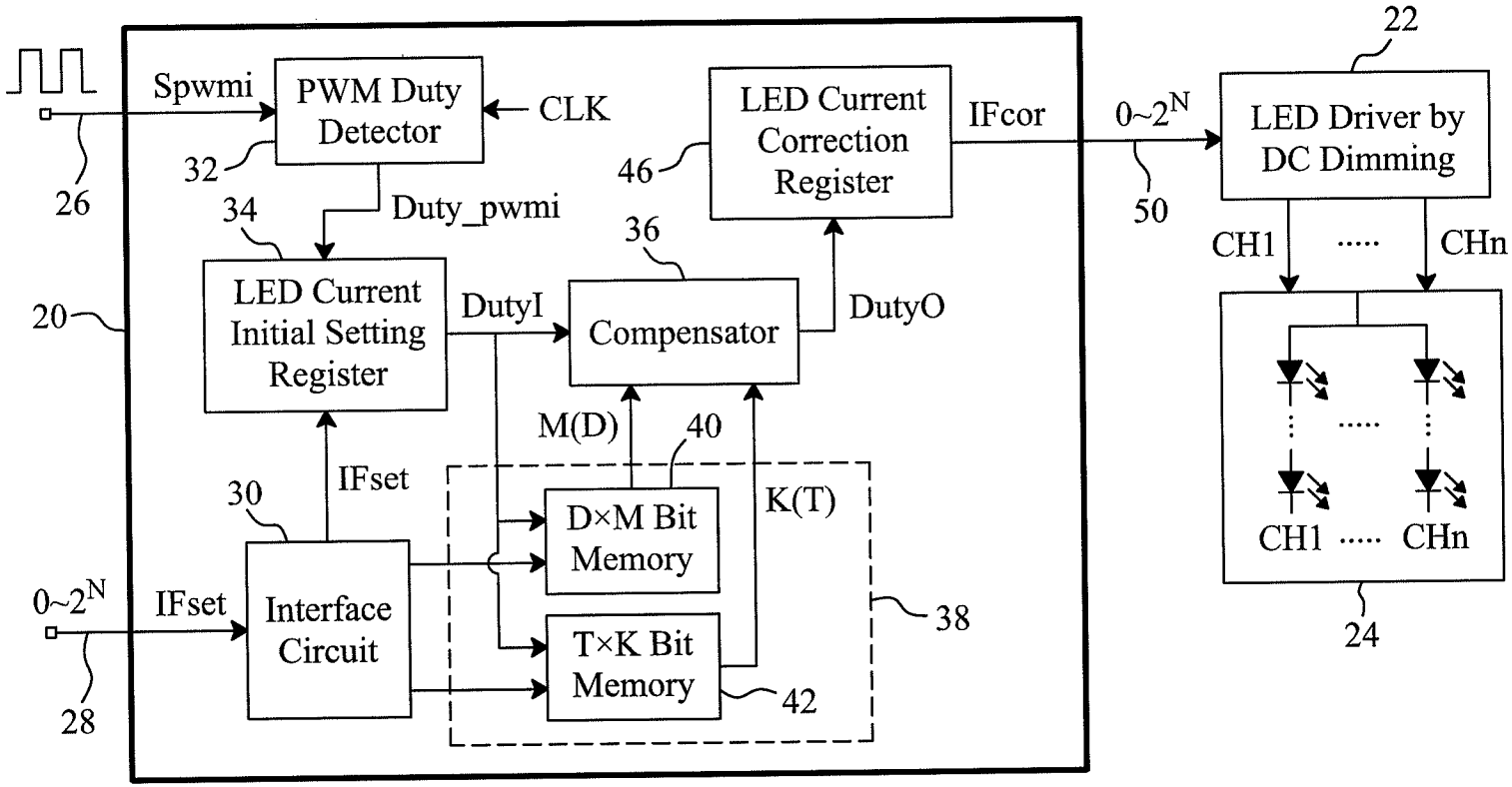
FIG. 7 shows a second embodiment of a LED dimming control circuit according to the present invention.

FIG. 7 shows a second embodiment of a LED dimming control IC 20, which has the same circuit as that of the first embodiment shown in FIG. 3, except the PWM duty generator 44, and thus does not have the PWM dimming mode.

Figure 8:
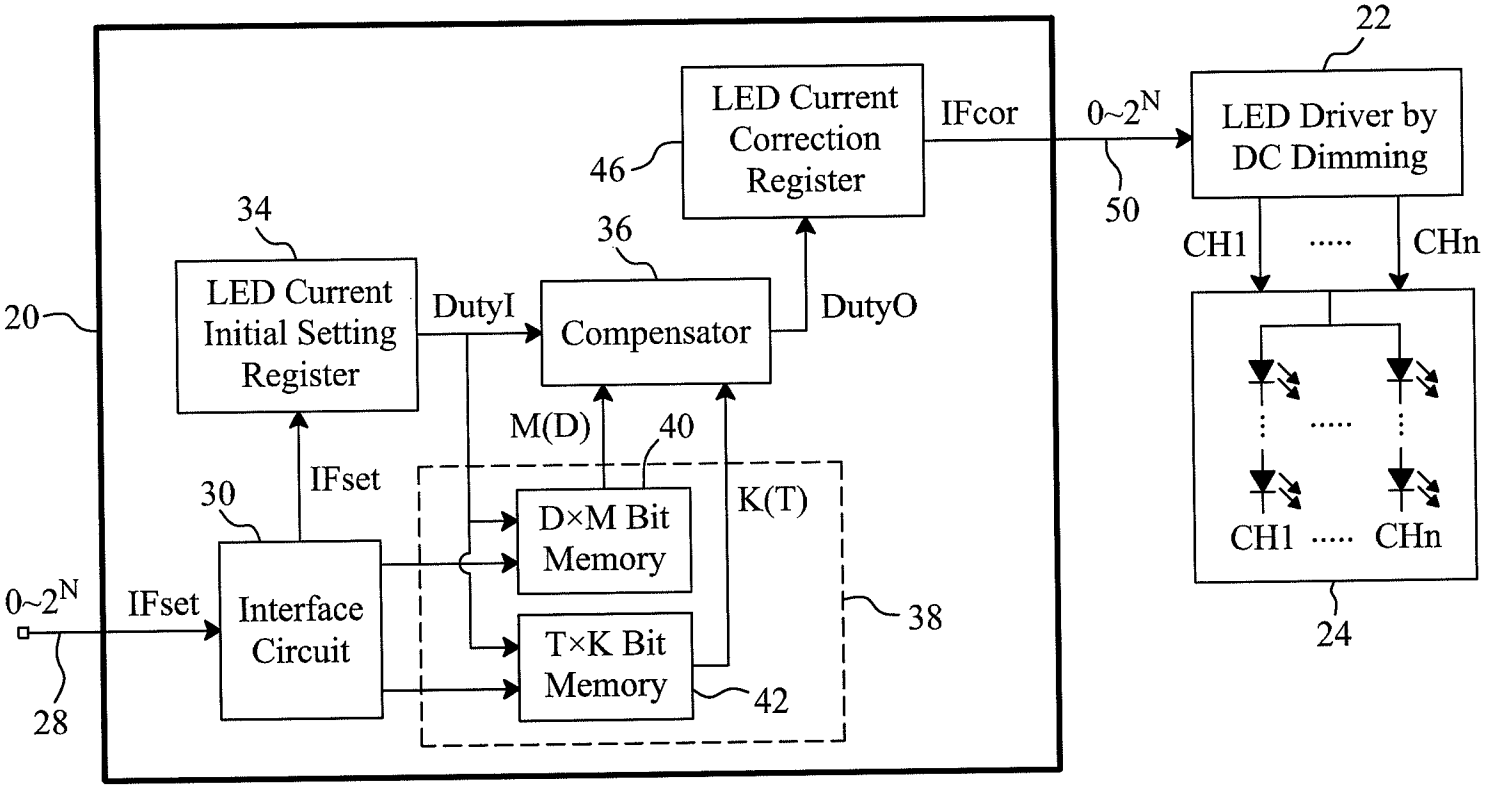
FIG. 8 shows a third embodiment of a LED dimming control circuit according to the present invention.

FIG. 8 shows a third embodiment of a LED dimming control IC 20, which has the same circuit as that of the second embodiment shown in FIG. 7, except the PWM duty detector 32, and thus has neither the PWM dimming mode nor the function of adjusting the LED current according to an input PWM signal Spwmi.

Figure 9:
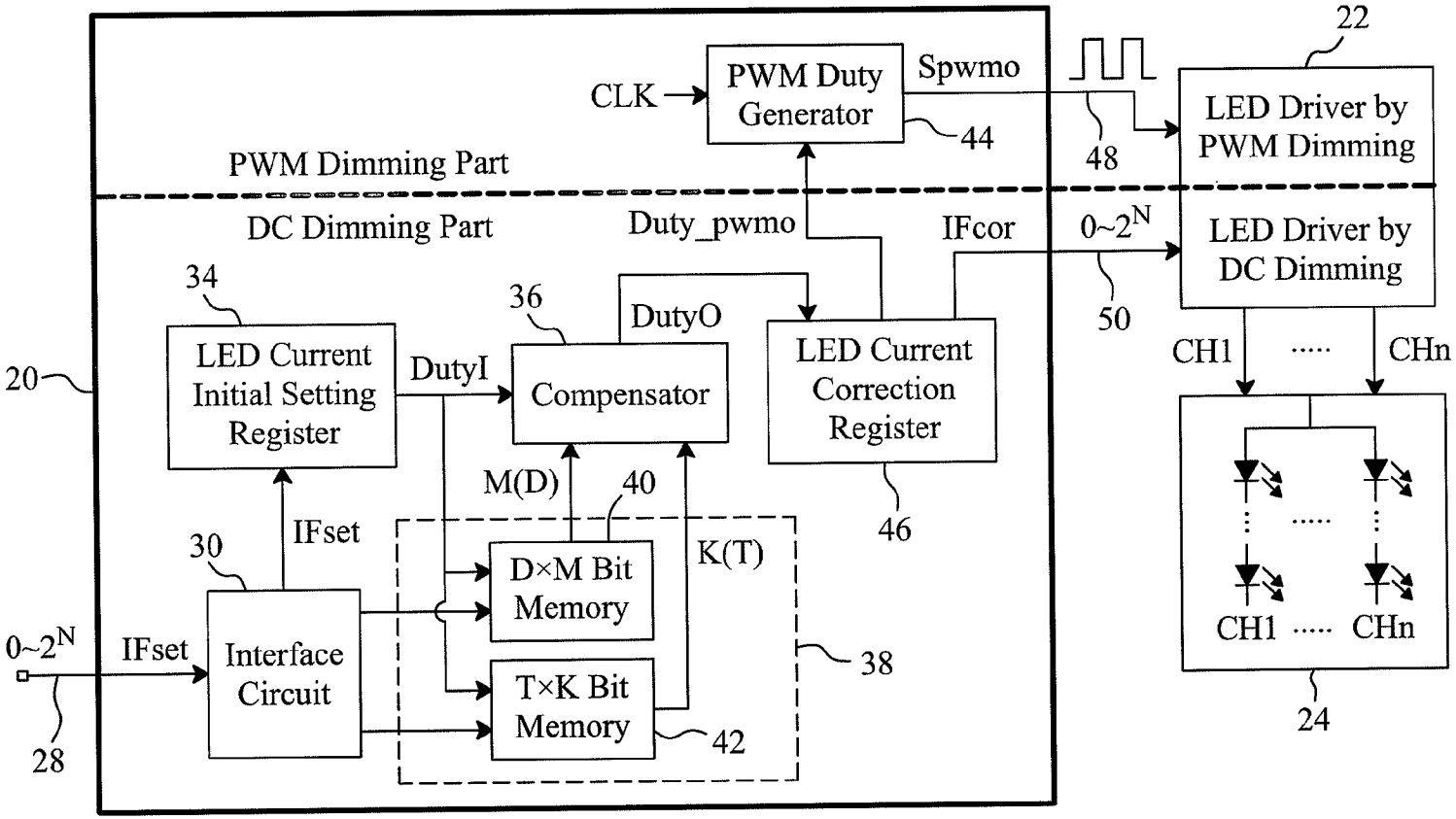
FIG. 9 shows a fourth embodiment of a LED dimming control circuit according to the present invention.

FIG. 9 shows a fourth embodiment of a LED dimming control IC 20, which has the same circuit as that of the first embodiment shown in FIG. 3, except the PWM duty detector 32, and thus does not have the function of adjusting LED current or LED average current according to an input PWM signal Spwmi.

Similar to the LED dimming control IC 20 shown in FIG. 6, the LED dimming control ICs 20 shown in FIGS. 7-9 may also receive and store LED brightness data B_data and LED temperature data T_data provided by the light sensor 58 and the temperature sensor 60 in the LED light source module 24, such that the memories 40 and 42 in the storage unit 38 may choose a most appropriate look-up table according to the stored LED brightness data B_data and the stored LED temperature data T_data to provide optimal compensation values M(D) and K(T).

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A LED dimming control circuit comprising:

a register configured to receive and store a first LED current setting information;

a storage unit connected to the register, configured to store a LED characteristic related look-up table and provide compensation values according to the first LED current setting information and the look-up table; and a compensator connected to the register and the storage unit, configured to compensate the first LED current setting information according to the compensation values to generate a second LED current setting information for determining LED brightness.

2. The LED dimming control circuit of claim 1, further comprising a second register connected to the compensator, configured to receive and store the second LED current setting information and provides the second LED current setting information at an output terminal of the LED dimming control circuit for adjusting LED current.

3. The LED dimming control circuit of claim 1, further comprising:

second register connected to the compensator, configured to receive and store the second LED current setting information; and a PWM duty generator connected to the second register, configured to generate an output PWM signal according to the second LED current setting information stored in the second register, and provide the output PWM signal at an output terminal of the LED dimming control circuit for adjusting LED average current.

4. The LED dimming control circuit of claim 1, further comprising an interface circuit connected to the register and an input terminal of the LED dimming control circuit, configured to receive the first LED current setting information from an input terminal of the LED dimming control circuit and transmit the first LED current setting information to the register.

5. The LED dimming control circuit of claim 1, further comprising an interface circuit connected to the storage unit, configured to write or update the look-up table.

6. The LED dimming control circuit of claim 1, wherein the storage unit chooses the look-up table according to LED brightness data and LED temperature data.

7. The LED dimming control circuit of claim 1, further comprising a PWM duty detector connected to the register and an input terminal of the LED dimming control circuit, responsive to a clock signal to detect a duty of an input PWM signal at the input terminal of the LED dimming control circuit for generating the first LED current setting information.

8. The LED dimming control circuit of claim 7, wherein the PWM duty detector comprises:

a sampling circuit responsive to the clock signal to sample the duty of the input PWM signal to generate a first sample value;

a hysteresis circuit connected to the sampling circuit, configured to store a second sample value generated by the sampling circuit in a previous sampling process, and generate the first LED current setting information according to the first sample value, the second sample value, an upper bound and a lower bound; and a frequency detector connected to the hysteresis circuit, configured to detect a frequency of the input PWM signal to generate a detection signal for signaling the hysteresis circuit to adjust the upper bound and the lower bound;

wherein if the first sample value is greater than the second sample value and the upper bound or if the first sample value is smaller than the second sample value and the lower bound, the first LED current setting information is determined according to the first sample value; otherwise, the hysteresis circuit maintains the first LED current setting information unchanged.

9. The LED dimming control circuit of claim 7, further comprising:

a second register connected to the compensator, configured to receive and store the second LED current setting information; and a PWM duty generator connected to the second register, configured to generate an output PWM signal according to the second LED current setting information stored in the second register, and provide the output PWM signal at an output terminal of the LED dimming control circuit for adjusting LED average current.

10. The LED dimming control circuit of claim 9, wherein the PWM duty generator is responsive to the clock signal to control a varying speed of a duty of the output PWM signal according to the first LED current setting information received from the PWM duty detector.

11. The LED dimming control circuit of claim 1, wherein the compensator comprises a multiplier to multiply the first LED current setting information by the compensation values to generate the second LED current setting information.

12. A LED dimming control method comprising:

receiving and storing a first LED current setting information;

providing compensation values according to the first LED current setting information and a LED characteristic related look-up table; and compensating the first LED current setting information according to the compensation values to generate a second LED current setting information for determining LED brightness.

13. The LED dimming control method of claim 12, further comprising adjusting LED current according to the second LED current setting information.

14. The LED dimming control method of claim 12, further comprising generating an output PWM signal according to the second LED current setting information for adjusting LED average current.

15. The LED dimming control method of claim 12, further comprising updating the look-up table.

16. The LED dimming control method of claim 12, further comprising choosing the look-up table according to LED brightness data and LED temperature data.

17. The LED dimming control method of claim 12, further comprising detecting a duty of an input PWM signal responsive to a clock signal for generating the first LED current setting information.

18. The LED dimming control method of claim 17, further comprising generating an output PWM signal according to the second LED current setting information for adjusting LED average current.

19. The LED dimming control method of claim 18, further comprising controlling a varying speed of a duty of the output PWM signal according to the first LED current setting information.

20. The LED dimming control method of claim 12, further comprising:

sampling a duty of an input PWM signal responsive to a clock signal for generating a first sample value;

determining an upper bound and a lower bound according to a frequency of the input PWM signal; and generating the first LED current setting information according to the first sample value, a stored second sample value, the upper bound and the lower bound;

wherein if the first sample value is greater than the second sample value and the upper bound or if the first sample value is smaller than the second sample value and the lower bound, the first LED current setting information is determined according to the first sample value; otherwise, the first LED current setting information remains unchanged.

21. The LED dimming control method of claim 12, wherein the step of compensating the first LED current setting information comprises multiplying the first LED current setting information by the compensation values to generate the second LED current setting information.

* * * * *